US007048598B2

(12) United States Patent
Uraki et al.

(10) Patent No.: US 7,048,598 B2
(45) Date of Patent: May 23, 2006

(54) JET PROPULSION BOAT

(75) Inventors: Mamoru Uraki, Wako (JP); Hideki Sugiyama, Wako (JP); Masahiko Tsuchiya, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/226,098

(22) Filed: Sep. 14, 2005

(65) Prior Publication Data

US 2006/0009095 A1 Jan. 12, 2006

Related U.S. Application Data

(63) Continuation of application No. 10/827,925, filed on Apr. 19, 2004.

(30) Foreign Application Priority Data

Apr. 23, 2003 (JP) ..... 2003-118352

(51) Int. Cl.
*F02D 23/00* (2006.01)

(52) U.S. Cl. ..... 440/1; 60/600; 60/602; 440/38

(58) Field of Classification Search ..... 440/1, 440/38, 39, 40, 41, 42, 43, 44, 45, 46, 47
See application file for complete search history.

(56) References Cited

U.S. PATENT DOCUMENTS

| | | | | |
|---|---|---|---|---|
| 5,190,487 | A | 3/1993 | Fukui | |
| 5,833,501 | A | 11/1998 | Jones | |
| 6,148,615 | A * | 11/2000 | Vogt et al. | 60/602 |
| 6,796,289 | B1 | 9/2004 | Uraki et al. | |
| 6,855,020 | B1 | 2/2005 | Kaji | |

FOREIGN PATENT DOCUMENTS

| | | |
|---|---|---|
| JP | 08-104293 | 4/1996 |
| JP | 2001-328591 | 11/2001 |

* cited by examiner

*Primary Examiner*—Sherman Basinger
(74) *Attorney, Agent, or Firm*—Hamre, Schumann, Mueller & Larson, P.C.

(57) ABSTRACT

To provide a jet propulsion boat that enables preventing the occurrence of cavitation. In a jet propulsion boat that jets water pressurized and accelerated by a water jet pump from a rear jet nozzle and is propelled by its reaction, a turbocharger is provided to an engine for driving the water jet pump and in case the rate of the rise of engine speed is a predetermined value or more, delay control is applied to the rise of the boost pressure of the turbocharger.

11 Claims, 6 Drawing Sheets

JET PROPULSION BOAT

This application is a continuation of application Ser. No. 10/827,925, filed Apr. 19, 2004, entitled JET PROPULSION BOAT, which application is incorporated herein by reference.

CROSS REFERENCE TO RELATED APPLICATIONS

This application claims priority to Japanese Patent Application No. 2003-118352 filed on Apr. 23, 2003.

FIELD OF THE INVENTION

The present invention relates to a boat that is propelled by jetting pressurized and accelerated water through a jet nozzle.

BACKGROUND OF THE INVENTION

Until now, to prevent the occurrence of cavitation in a water jet driven personal water craft, the number of revolutions of a water jet pump is controlled. For an example, refer to JP-A-2001-328591, which discloses an invention for avoiding cavitation in a water jet boat without depending upon the experience and intuition of a pilot. According to this invention, a water jet pump is operated based upon the practical target number of revolutions and the actual number of revolutions by calculating the actual number of revolutions of a water jet pump and the cavitation limit number of revolutions showing the limit of the occurrence of cavitation corresponding to the number of revolutions of the pump and selecting either smaller one of the cavitation limit number of revolutions or the target number of revolutions as the practical target number of revolutions when the target number of revolutions of the water jet pump is input.

The inclusion of a turbocharger (power booster) in a water jet driven personal water craft (jet propulsion boat) can enable rapid acceleration of the personal water craft. However, when engine speed and the number of revolutions of a water jet pump rapidly rise, the flow velocity of a stream flowing in a duct also similarly rapidly rises. This causes a rapid decrease in hydraulic pressure in the duct. When the hydraulic pressure exceeds saturated vapor pressure, bubbles (cavities) are formed at ordinary temperature thereby resulting in cavitation.

FIG. 6 summarizes this problem. In particular, it shows that when a throttle valve (TH) is fully opened, engine (ENG) speed NE accordingly rises. The target boost pressure of the turbocharger also rapidly rises according to the rapid rise of the engine speed and engine speed further rapidly rises. When engine speed or the rate of the rise of engine speed reaches a certain value, cavitation occurs and results in irregular engine speed or hunting. (See a part A in FIG. 6).

In other words, as thrust energy to be originally used for propelling a boat is consumed in vain by the vaporization energy of water, thereby causing vibrations of an impeller of the water jet pump and other parts.

The invention is made to prevent such a situation. The object is to provide a jet propulsion boat that enables preventing hunting by preventing cavitation.

BRIEF SUMMARY OF THE INVENTION

The invention relates to a jet propulsion boat that jets water pressurized and accelerated by a water jet pump from a rear jet nozzle and is propelled by its reaction. The jet propulsion boat includes a power booster turbocharger that can be controlled if the rate of the rise of engine speed is a predetermined value or more.

By such configuration, if a throttle is fully opened and the engine speed rapidly rises to a predetermined value or more, delay control is applied to the rise of the boost pressure of the power booster and the rise of engine speed can be inhibited.

DETAILED DESCRIPTION OF THE INVENTION

Figure 1:
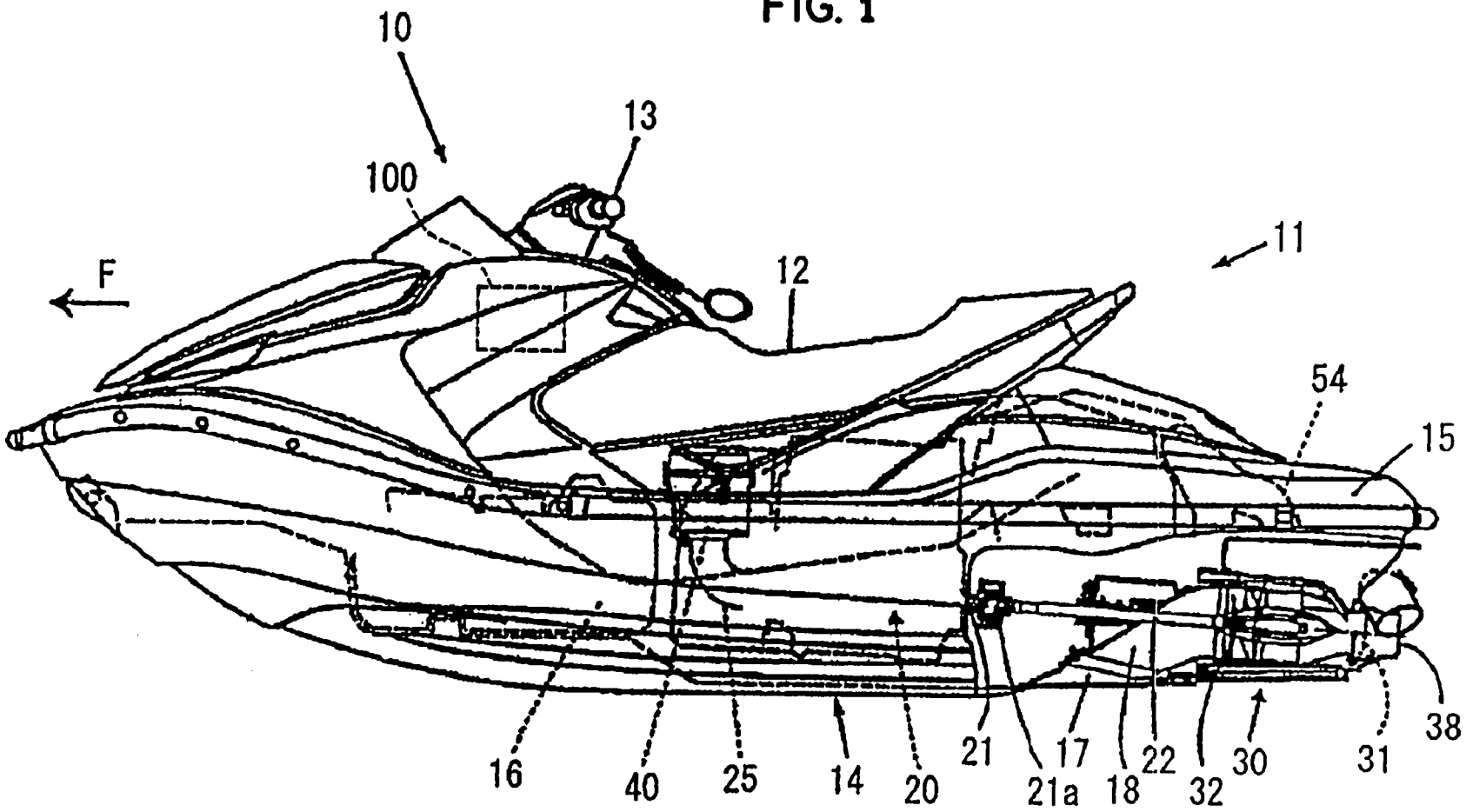
FIG. 1 is a side view a part of which is cut out showing a jet propulsion boat equivalent to this embodiment.
Figure 2:
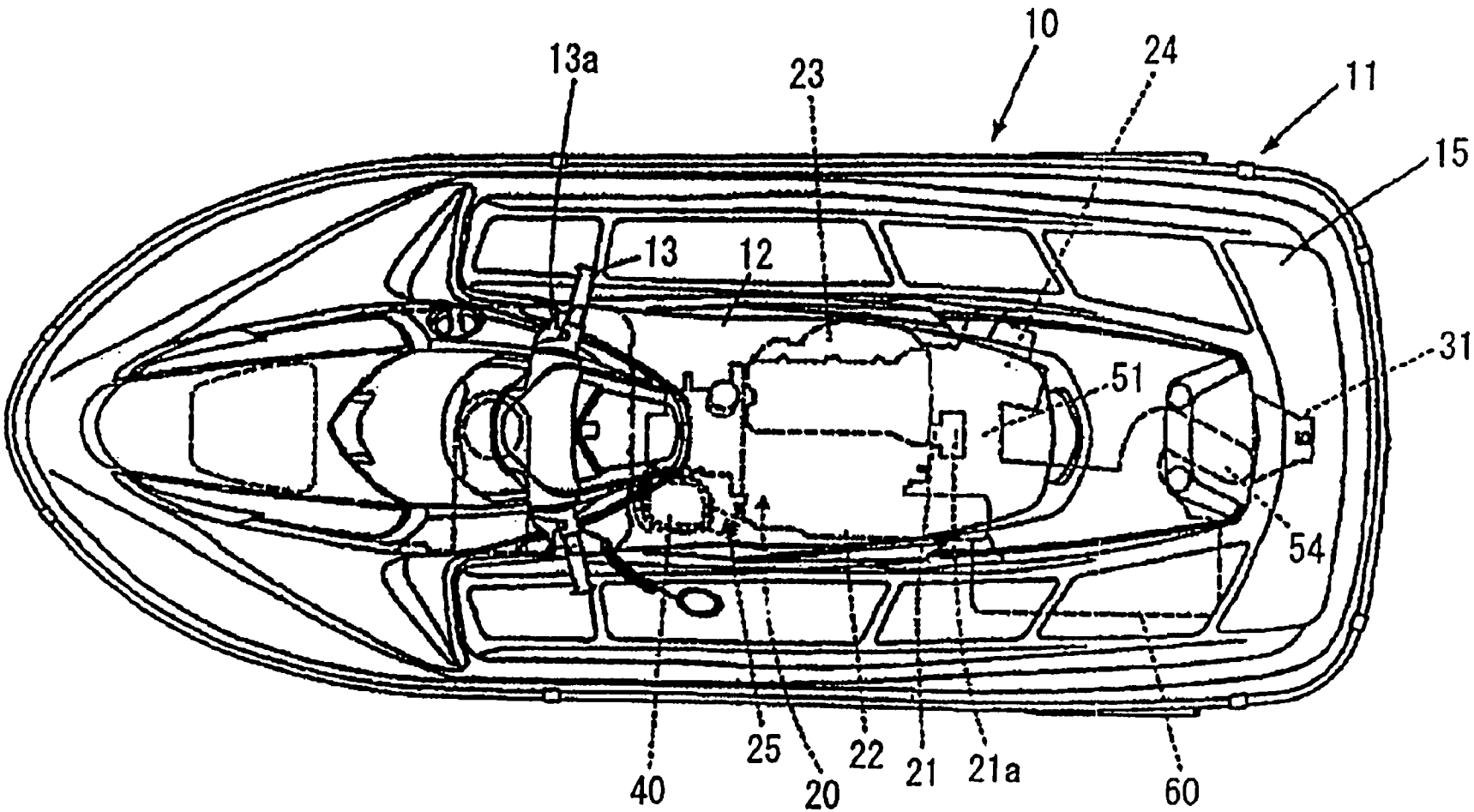
FIG. 2 is a plan showing the same jet propulsion boat.

Referring to the drawings, one embodiment of a jet propulsion boat according to the invention will be described below. FIG. 1 is a side view a part of which is cut out showing a jet propulsion boat equivalent to this embodiment and FIG. 2 is a plan showing the same jet propulsion boat.

As shown in these drawings (mainly FIG. 1), the jet propulsion boat 10, otherwise commonly known as a personal water craft, is a saddle-type small-sized boat, a crew sits on a seat 12 on the body 11, and the output of an engine 20 is adjusted by gripping and operating a steering handlebar 13 with a throttle lever and adjusting an opening of a throttle valve (not shown) of the engine 20.

The body of the boat 11 has floating structure acquired by bonding a hull 14 and a deck 15 and forming space 16 inside. In the space 16, the engine 20 is mounted above the hull 14 and a water jet pump 30 as propelling means driven by the engine 20 is provided to the rear of the hull 14.

The water jet pump 30 is provided with an impeller 32 arranged in a duct 18 extended from an intake 17 open to the bottom to a deflector 38 via an exhaust nozzle 31 open to the rear end of the body, and a drive shaft 22 for driving the impeller 32 is coupled to the output shaft 21 of the engine 20 via a coupler 21*a*.

Therefore, when the impeller 32 is rotated by the engine 20 via the coupler 21*a* and the shaft 22, water taken in from the intake 17 is jetted from the exhaust nozzle 31 via the deflector 38 and hereby, the body 11 is propelled.

The number of revolutions of the engine 20, that is, propelling force by the water jet pump 30 is operated by the turning operation of the throttle lever 13*a* (see FIG. 2) of the steering handlebar 13. The deflector 38 is linked with the steering handlebar 13 via operating wire not shown, is turned by the operation of the handlebar 13 and hereby, a course of the body 11 can be changed.

Figure 3:
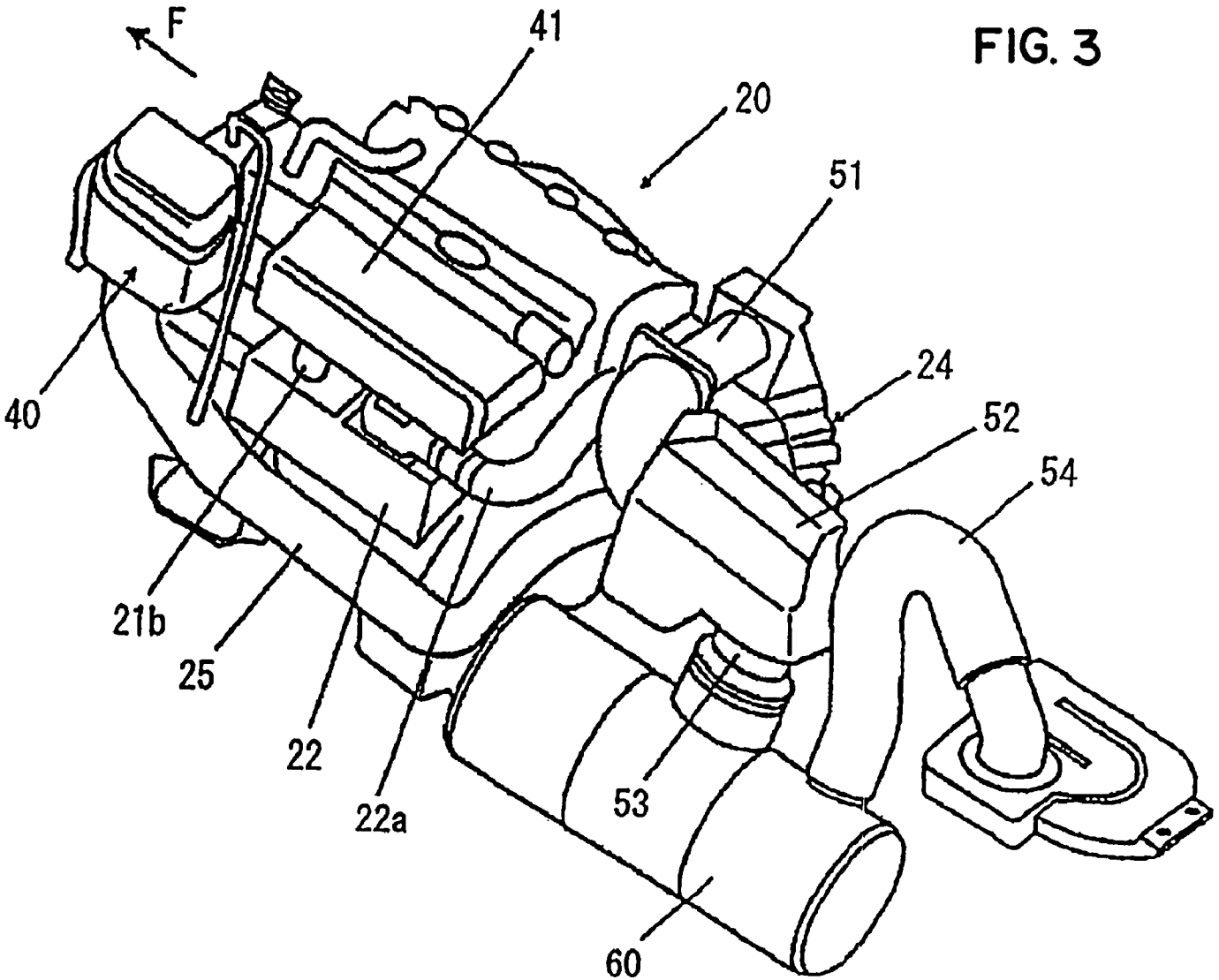
FIG. 3 is a schematic perspective view mainly showing an engine and a turbocharger.

FIG. 3 is a schematic perspective view mainly showing the engine 20.

The engine 20 is a DOHC-type in-line four-cylinder dry sump-type four-cycle engine and its crankshaft (see the output shaft 21 shown in FIG. 1) is arranged along the longitudinal direction of the body 11.

As shown in FIGS. 1 to 3, a surge tank 41 and an inter-cooler 22 are connected and arranged on the left side of the engine 20 in the traveling direction F of the body 11 and an exhaust manifold 23 is arranged on the right side of the engine 20.

A turbocharger 24 for feeding compressed intake air to the engine 20 is arranged at the back of the engine 20 and an air cleaner case 40 for taking new air in the turbocharger 24 via a pipe 25 is arranged in front of the engine 20.

An exhaust outlet of the exhaust manifold 23 (see FIG. 2) is connected to a turbine of the turbocharger 24. Besides, the inter-cooler 22 is connected to a compressor of the turbocharger 24 via a pipe 22*a* and the surge tank 41 is connected to the inter-cooler 22 via a pipe 21*b*. Therefore, after new air from the air cleaner case 40 is supplied to the turbocharger 24 via the pipe 25, is compressed in its compressor and is supplied and cooled to/in the inter-cooler 22 via the pipe 22*a*, the new air is supplied to the engine 20 via the surge tank 41.

Exhaust gas which fulfills the role of turning the turbine of the turbocharger 24 is exhausted into a water muffler 60 via a first exhaust pipe 51, a back flow preventing chamber 52 for preventing the back flow of water in a turnover (the penetration of water into the turbocharger 24 and others) and a second exhaust pipe 53, and is further exhausted into a stream made by the water jet pump 30 from the water muffler 60 via-an exhaust gas/waste water pipe 54.

An engine speed sensor that senses engine speed and a throttle angle sensor that senses an angle of the throttle valve are provided to the engine 20. A boost pressure sensor that senses boost pressure is provided to the turbocharger 24. The engine speed sensor, the throttle angle sensor and the boost pressure sensor are connected to a controller 100 of the jet propulsion boat 10. Values measured by these sensors are constantly output to the controller 100. The controller 100 is an engine control unit (ECU) that controls the engine 20, the turbocharger 24 and other parts of the engine.

Figure 4:
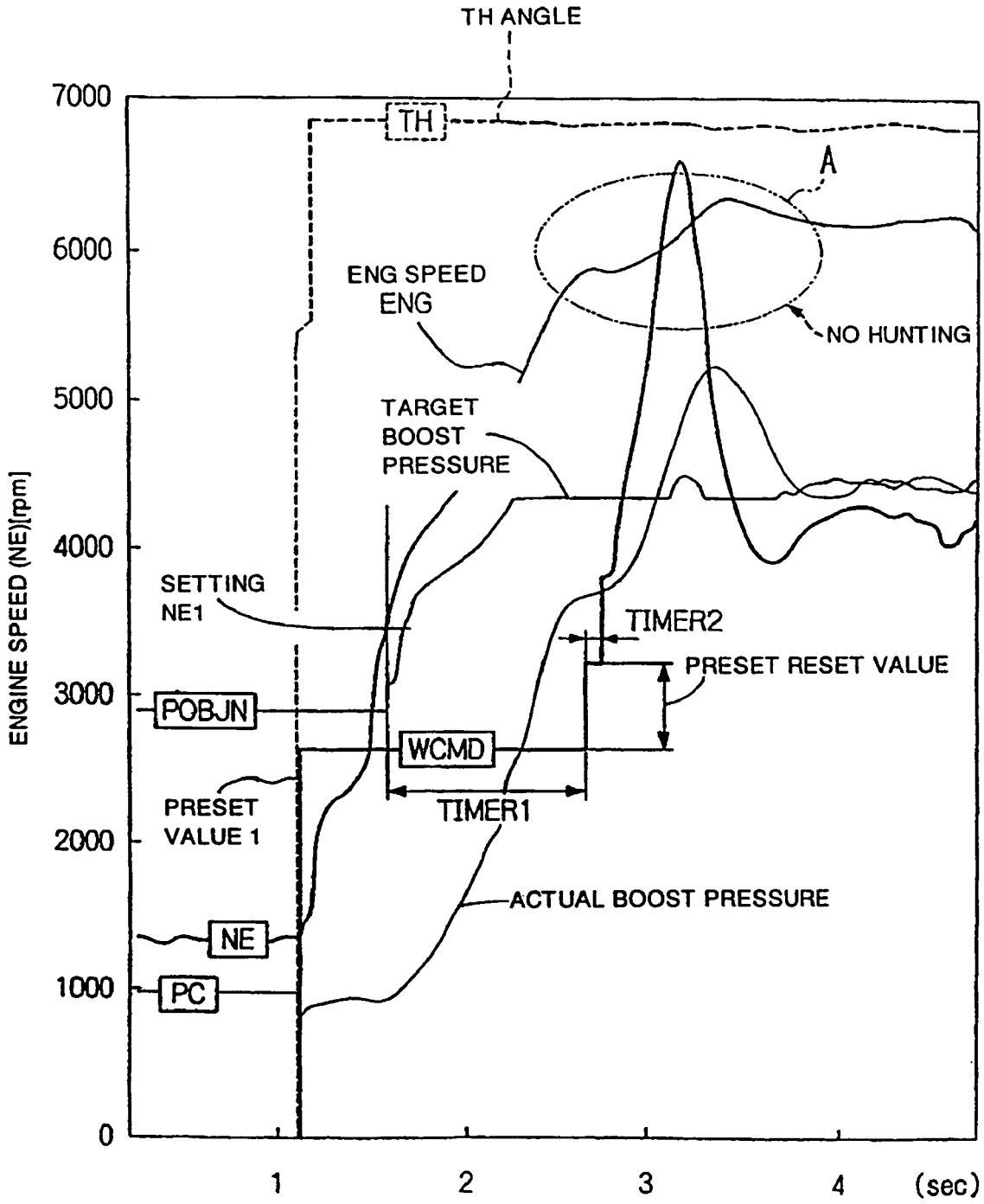
FIG. 4 is a graph mainly showing the variation in time of engine speed.
Figure 5:
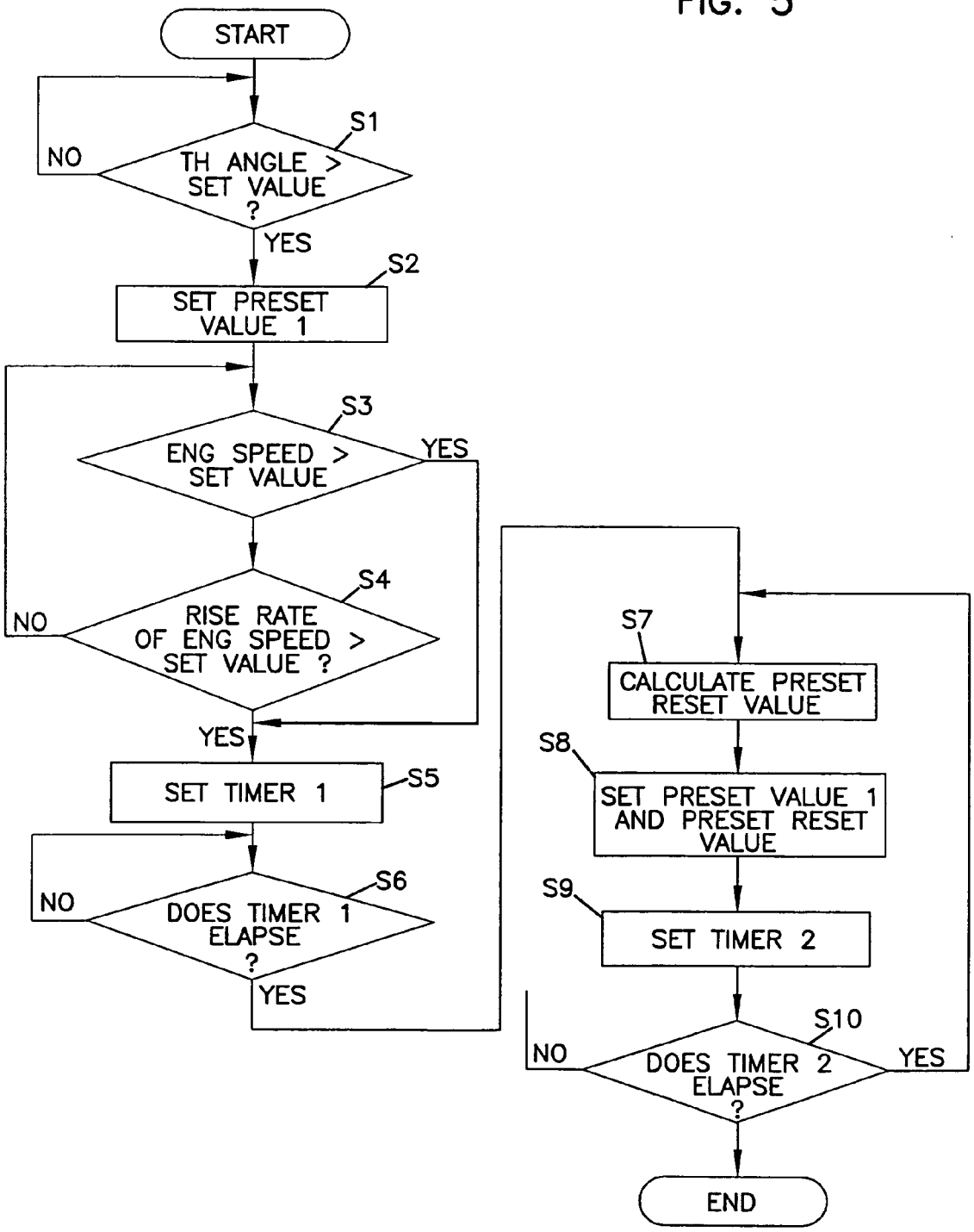
FIG. 5 is a flowchart showing the flow of a boost pressure control process.
Figure 6:
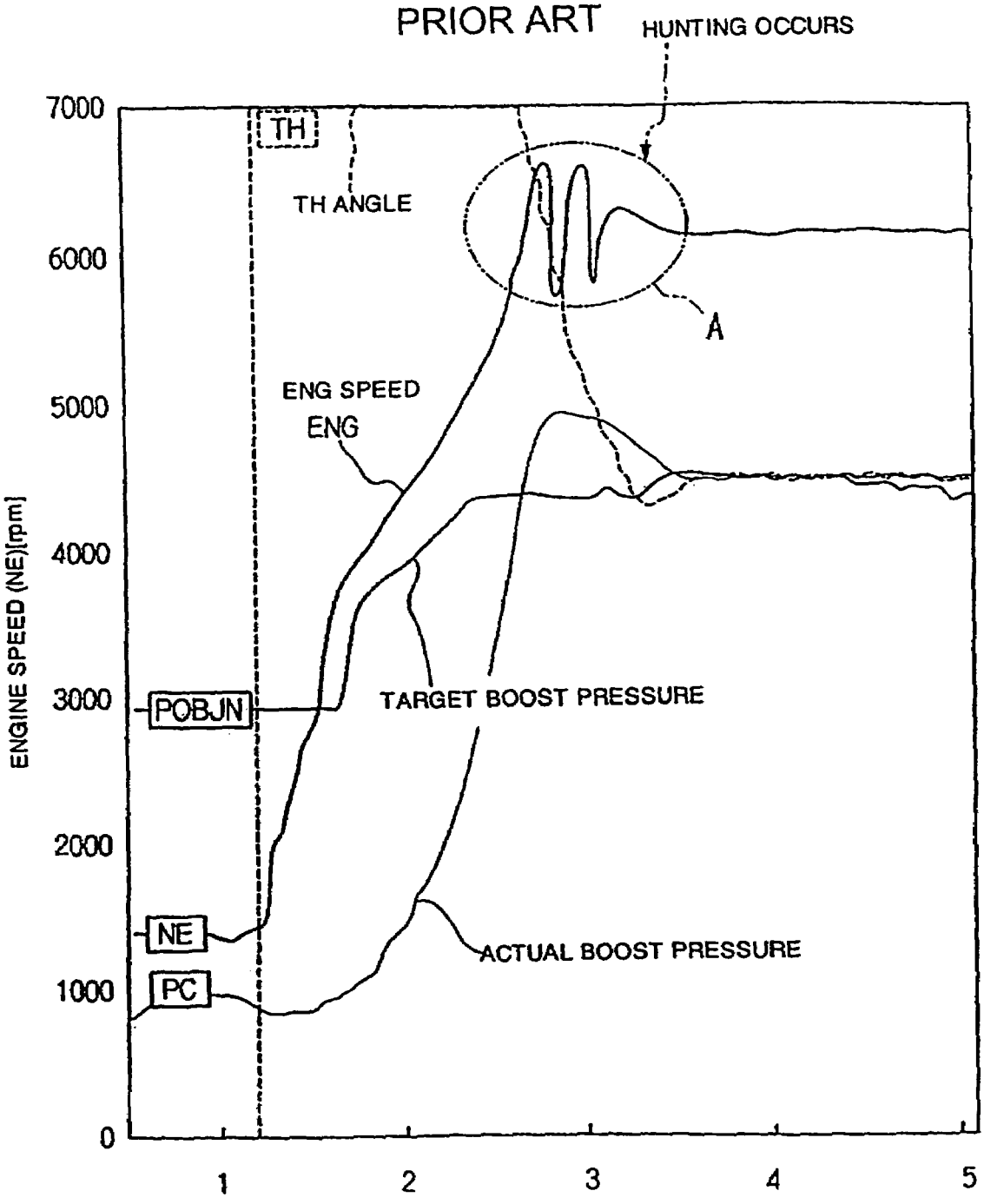
FIG. 6 PRIOR ART
FIG. 6 is a graph showing the variation in time of the engine speed of a conventional type.

Next, referring to the drawings, the operation of the jet propulsion boat equivalent to this embodiment will be described. FIG. 4 is a graph showing the variation in time of engine (ENG) speed NE in the jet propulsion boat equivalent to this embodiment. In this graph, the x-axis shows time (sec) and the y-axis shows engine speed (rpm). FIG. 5 is a flowchart showing the flow of a boost pressure control process in the jet propulsion boat equivalent to this embodiment.

At time 0, as an angle of the throttle valve TH is small, engine speed NE, boost pressure PC are stably kept low. At this time, the engine speed sensor measures engine speed NE and outputs it to the controller 100. The throttle angle sensor measures an angle of the throttle valve TH and outputs it to the controller 100.

The controller 100 receives the input of the angle of the throttle valve TH, reads target boost pressure POBJN corresponding to input engine speed based upon a program map of target boost pressure POBJN written to ROM of the controller 100 beforehand and controls the boost pressure of the turbocharger 24 based upon the target boost pressure POBJN. At this time, as the engine speed NE is low, target boost pressure POBJN read based upon the program map has a higher value than actual boost pressure PC.

Suppose that an angle of the throttle valve TH of the engine 20 is made fully open because a rider grips the steering handlebar 13 provided with the throttle lever. At this time, the engine speed sensor measures engine speed NE and outputs it to the controller 100. The throttle angle sensor measures an angle (fully open) of the throttle valve TH and outputs it to the controller 100. The controller 100 receives the input of the angle of the throttle valve TH and determines whether the input value is a preset value or more (a step S1 in FIG. 5). It is a value in a fully open state that is a set value for an angle of the throttle valve in this embodiment.

The controller 100 sets a preset value 1 of boost pressure stored in ROM using time when the throttle valve becomes fully open as a trigger (Yes in the step S1) at this time and controls the boost pressure of the turbocharger 24 based upon the preset value 1 (a step S2). In the meantime, in case an angle of the throttle valve does not reach the set value (No in the step S1), the step S1 is repeated again.

The preset value 1 in a boost pressure control command WCMD is naturally set to a lower value than the target boost pressure used for the control of the turbocharger 24. The preset value 1 has a fixed value for a time base.

When the throttle valve (TH) is fully opened, engine speed NE accordingly rises. The controller 100 executes feedback control over the target boost pressure POBJN based upon the raised engine speed NE. That is, the controller 100 calculates target boost pressure POBJN corresponding to the raised engine speed NE.

The calculated target boost pressure POBJN follow the rapid rise of the engine speed NE.

That is, the target boost pressure POBJN of the turbocharger also rapidly rises together with engine speed NE, however, the controller 100 controls the boost pressure of the turbocharger 24 based upon the corresponding preset value 1. The engine speed sensor further measures engine speed NE for this while and outputs it to the controller 100.

The controller 100 determines whether input engine speed NE is a set value or more. When engine speed NE reaches the set value (setting NE1 shown in FIG. 4)(Yes in a step S3), the controller sets a timer using this as a trigger (a step S5) and further controls the boost pressure of the turbocharger 24 based upon the corresponding preset value 1 by fixed time (TIMER1) from this time.

In case engine speed NE does not reach the set value (No in the step S3), the controller 100 further calculates the rate of the rise of engine speed NE per time based upon input engine speed NE and elapsed time. When the calculated rate of the rise of engine speed NE reaches a set value (Yes in the step S4), the controller 100 sets the timer using this as a trigger (the step S5) and further controls the boost pressure of the turbocharger 24 based upon the corresponding preset value 1 by fixed time (TIMER1) from this time.

In the meantime, in case neither engine speed NE nor the rate of the rise of engine speed reach each set value (No in the step S4), processing is repeated from the step S3 again.

When it is determines by the timer that fixed time (TIMER1) elapses (Yes in a step S6) since engine speed NE or the rate of the rise of engine speed NE reaches its set value, the controller 100 calculates a preset reset value based upon actual boost pressure PC at the time and target boost pressure POBJN (a step S7).

The controller 100 adds the calculated preset reset value to the preset value 1 and sets the added value (a step S8). The controller newly sets the timer using the setting of the added value as a trigger as in the step S5 (a step S9) and further controls the boost pressure of the turbocharger 24 based upon the corresponding added value (the preset value 1+the preset reset value) by fixed time (TIMER2) from this time.

When it is determined by the timer that fixed time (TIMER2) elapses (Yes in a step S10) since the added value is set, the controller 100 similarly calculates a preset reset value based upon actual boost pressure PC at the time and target boost pressure POBJN, further adds the calculated preset reset value and controls the boost pressure of the turbocharger 24 based upon the added value. In the meantime, the controller 100 controls the boost pressure of the turbocharger 24 based upon the added value until fixed time (TIMER2) elapses (No in the step S10).

The controller 100 executes the above-mentioned process until actual boost pressure PC is stabilized at target boost pressure POBJN, for example until the absolute value of the preset reset value is a set value or less.

The rate of the rise of engine speed is securely limited by such control over the boost pressure of the turbocharger 24 so that the rate is a fixed value or less. As for the engine 20 and the water jet pump 30, the drive shaft 22 for drive of the impeller 32 is coupled to the output shaft 21 of the engine 20 via the coupler 21*a,* the number of revolutions of the water jet pump is determined together with the corresponding engine speed.

Therefore, if the allowable rate of the rise of the number of revolutions of the water jet pump is determined based upon a characteristic of the occurrence of cavitation in the water jet pump, the rate of the rise of engine speed or engine speed (the setting NE1) can be determined.

The rise of the number of revolutions of the water jet pump in which cavitation occurs can be avoided by setting a value of the timer as described above.

Therefore, according to the jet propulsion boat equivalent to this embodiment, effect that the occurrence of cavitation in the water jet pump 30 can be prevented and the vain consumption of thrust energy can be prevented is acquired.

Besides, as engine speed can be also stabilized as shown in A in FIG. 4 at the time of rapid acceleration by preventing the occurrence of cavitation, effect that the increase of vibration can be inhibited is further acquired.

The embodiment of the invention is described above, however, the invention is not limited to the embodiment and can be suitably transformed in a range of the object of the invention.

As described above, according to the invention, as delay control is applied to the rise of the boost pressure of the power booster and the rate of the rise of engine speed is inhibited in case the throttle is fully opened, engine speed rapidly rises and the rate of the rise of engine speed is the predetermined value or more, effect that the occurrence of cavitation can be prevented can be acquired.

According to an alternate embodiment, as the throttle is fully opened, engine speed rapidly rises, in case engine speed exceeds the predetermined value, the boost pressure of the power booster is limited and the rapid rise of engine speed is inhibited. As a result, the occurrence of cavitation can be prevented.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A method for controlling a boost pressure in a turbocharger of a jet propulsion boat using a controller to control the boost pressure, the method comprising the steps of:

(a) receiving a throttle valve angle input value;

(b) determining whether the throttle valve angle input value reaches a set throttle angle value or more;

(c) setting a preset value of a boost pressure after the throttle angle input value reaches the set throttle angle value or more;

(d) receiving an engine speed input value;

(e) determining whether the engine speed input value reaches a set engine speed value or more;

(f) setting a first fixed time after the engine speed input value reaches the set engine speed value or more;

(g) calculating a preset reset value of a boost pressure after the first fixed time has elapsed;

(h) setting an added value defined by adding the preset reset value and the preset value;

(i) setting a second fixed time after the added value is set; and (j) controlling the boost pressure of the turbocharger based on the added value and until the second fixed time elapses.

2. The method according to claim 1, further comprising repeating the determining step (b) if the throttle valve angle input value does not reach the set throttle angle value.

3. The method according to claim 1, wherein setting the preset value of a boost pressure includes setting the preset value to a lower value than a target boost pressure.

4. The method according to claim 1, further comprising controlling the boost pressure based upon the preset value.

5. The method according to claim 1, further comprising controlling the boost pressure based upon the preset value and for the first fixed time set.

6. The method according to claim 1, further comprising calculating a rate of rise of engine speed, which is based upon an input engine speed and an elapsed time, if the engine speed input value does not reach the set engine speed value in step (e), wherein when the calculated rate of rise of engine speed reaches a set rate of rise value, then the first timer may be set.

7. The method according to claim 6, further comprising repeating the determining step (e) if the engine speed input value does not reach the set engine speed value or does not reach the rate of rise of engine speed value.

8. The method according to claim 6, further comprising repeating the calculating step if the engine speed input value does not reach the set engine speed value or does not reach the rate of rise of engine speed value.

9. The method according to claim 1, wherein the preset reset value calculated is based on an actual boost pressure at a present time and a target boost pressure.

10. The method according to claim 1, wherein after the second fixed time has elapsed, further repeating steps (g) through (i) until an actual boost pressure is stabilized at a target boost pressure.

11. The method according to claim 1, further comprising stabilizing an actual boost pressure at a set value of a target boost pressure, wherein the preset reset value reaches the set value of the target boost pressure.

* * * * *